United States Patent [19]

Rogers

[11] 4,191,122

[45] Mar. 4, 1980

[54] SAFETY STOPPING DEVICE FOR A SEWING MACHINE

[75] Inventor: Howard D. Rogers, Tokyo, Japan

[73] Assignee: The Singer Company, New York, N.Y.

[21] Appl. No.: 39,521

[22] Filed: May 16, 1979

[51] Int. Cl.[2] ..... D05B 83/00

[52] U.S. Cl. ..... 112/261; 112/277; 361/179; 340/679; 83/58; 409/134; 192/129 A

[58] Field of Search ..... 112/261, 277, 275, 40; 307/116; 361/179; 340/540, 573, 679; 83/58, 68; 408/5; 409/134; 192/129 A

[56] References Cited

U.S. PATENT DOCUMENTS

| | | | |
|---|---|---|---|
| 2,541,549 | 2/1951 | Sampson | 112/261 |
| 3,019,751 | 2/1962 | Fichera | 112/261 |
| 3,500,782 | 3/1970 | Smith | 112/261 |
| 3,837,383 | 9/1974 | Ko | 409/134 X |
| 3,858,095 | 12/1974 | Friemann et al. | 361/179 X |
| 4,075,961 | 2/1978 | Harris | 112/277 |
| 4,150,634 | 4/1979 | Brown et al. | 112/261 X |

FOREIGN PATENT DOCUMENTS

| | | | |
|---|---|---|---|
| 1258279 | 12/1971 | United Kingdom | 192/129 A |
| 1393292 | 5/1975 | United Kingdom | 192/129 A |

*Primary Examiner*—Werner H. Schroeder
*Assistant Examiner*—A. M. Falik
*Attorney, Agent, or Firm*—Robert E. Smith; Edward L. Bell; William V. Ebs

[57] ABSTRACT

A sewing machine is provided with a safety device which protects an operator's fingers from the needle and includes a ring suspended over the presser foot of the machine. The suspended member is movable by finger pressure applied thereto in any direction and when so moved, completes an electric circuit to shut off the machine.

10 Claims, 7 Drawing Figures

SAFETY STOPPING DEVICE FOR A SEWING MACHINE

BACKGROUND OF THE INVENTION

1. Field of the Invention

The invention is directed to a safety device for use on a sewing machine and more particularly to a safety device intended to prevent injury to an operator's fingers.

2. Description of the Prior Art

It is well known to provide sewing machines with guards of various types effective to hinder an operator from moving his finger under a sewing needle. Sewing machine guards which permit the operation of a machine only when properly positioned to protect an operator's fingers are also known. In addition, non-contact sensors of various kinds have been employed to detect the presence of an operator's fingers in a danger area and discontinue the operation of a sewing machine. In general, however, the prior art devices have been too costly or have failed to provide adequate protection.

It is a prime object of this invention to provide a manually operable finger protecting device which can be cheaply constructed, which is actuable by finger pressure applied to it in any direction, and which when so moved, is effective to discontinue the operation of a sewing machine.

SUMMARY OF THE INVENTION

A finger protecting device which attaches to a sewing machine is provided with a ring to encircle the needle of a sewing machine, and with a supporting member to hold the ring over the presser foot of the machine. The supporting member includes a spherical bulb at an intermediate location which is mounted in a spherical socket provided in a fixed housing. Such supporting member is biased to a central position in the housing of the finger protecting device, but is movable therefrom by finger pressure in any direction on the ring, and when moved from its central position, the supporting member causes a conducting ring in the housing to be engaged by a conducting ring on the supporting member to thereby render a circuit effective to discontinue operation of the sewing machine.

DESCRIPTION OF THE INVENTION

Figure 2:
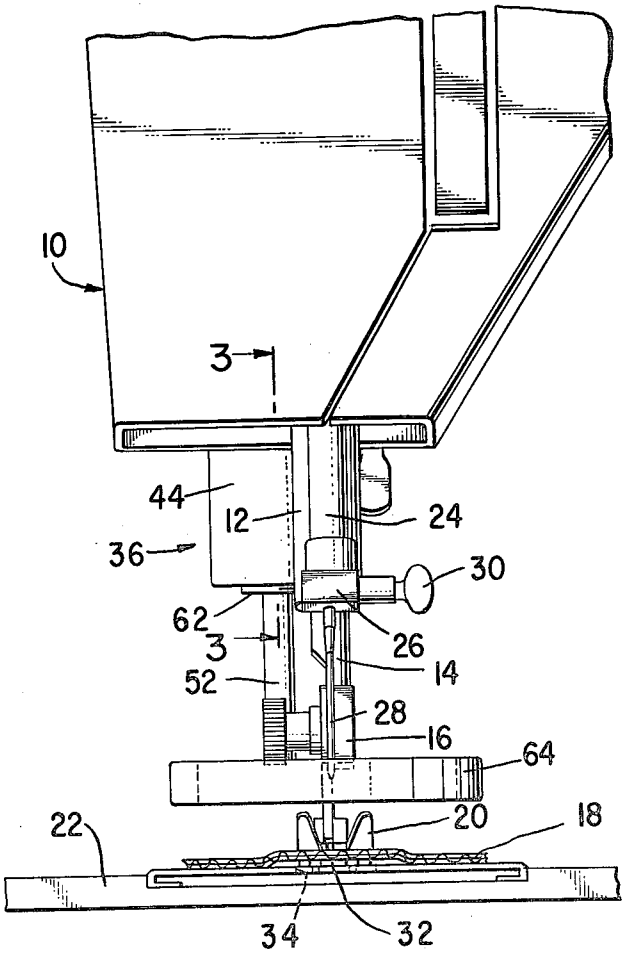
FIG. 2 is a front elevational view of the sewing machine fragment of FIG. 1 including the safety device of the invention.
Figure 1:
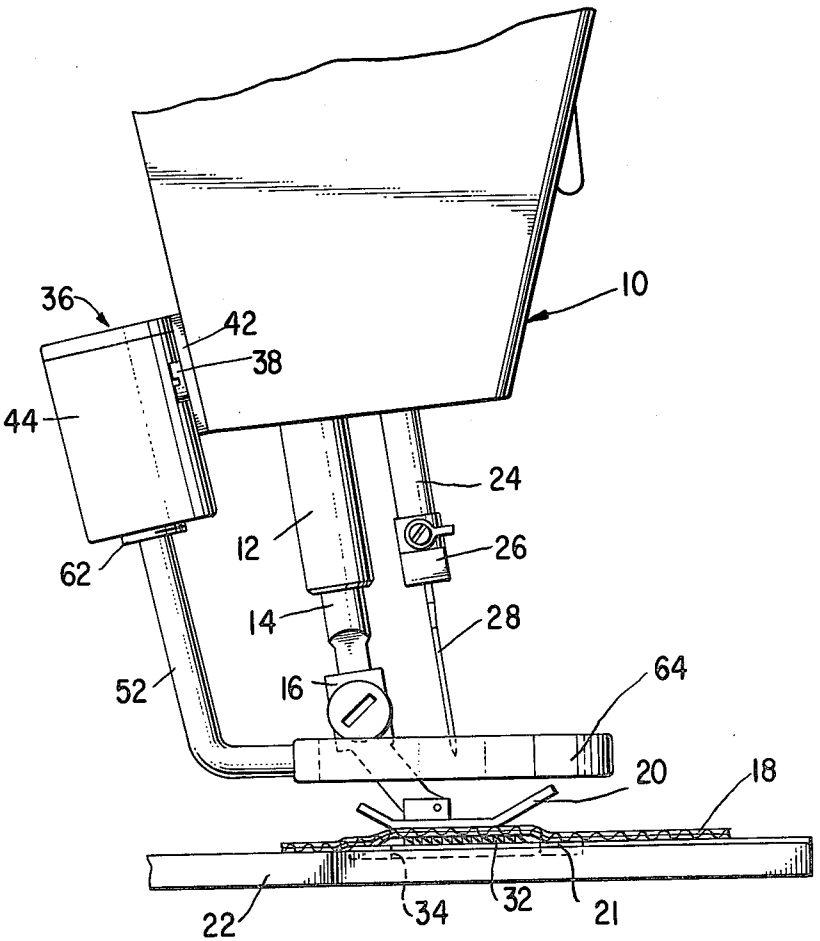
FIG. 1 is an end elevational view of a fragment of a sewing machine showing the safety device of the invention thereon.

Referring to FIGS. 1 and 2 of the drawings, reference character 10 designates the head end portion of a sewing machine including a fixed bushing 12 wherein a presser bar 14 is endwise slidable. Such presser bar carries a work presser device 16 which presses work fabrics 18 disposed under a sole plate 20 at the lower end of the device against a throat plate 21 carried on a work supporting bed 22 of the machine. Journalled in the machine for endwise reciprocation parallel to the presser bar in head end portion 10 of the machine is a needle bar 24 having a needle clamp 26 at its lower extremity wherein a needle 28 is affixed with a clamping screw 30. Such needle cooperates in conventional fashion with a loop taker (not shown) beneath the bed in the formation of stitches. The feed dog 32 of a conventional sewing machine mechanism (not shown) operates through slots 34 in the throat plate in the usual way, being cause to alternately rise into engagement and drop out of engagement with the work fabric, that is during feed and return strokes respectively, such that the work fabric is advanced under the sewing needle between stitches.

Figure 3:
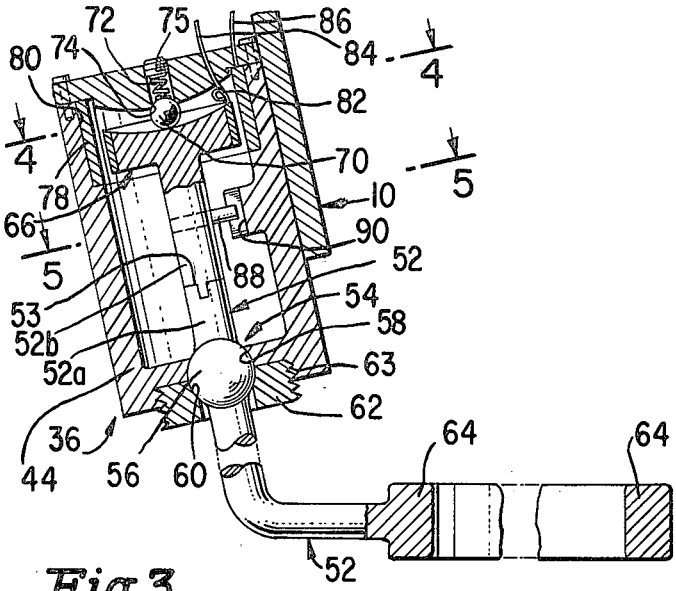
FIG. 3 is a sectional view taken through the safety device on the line 3—3 of FIG. 2.
Figure 4:
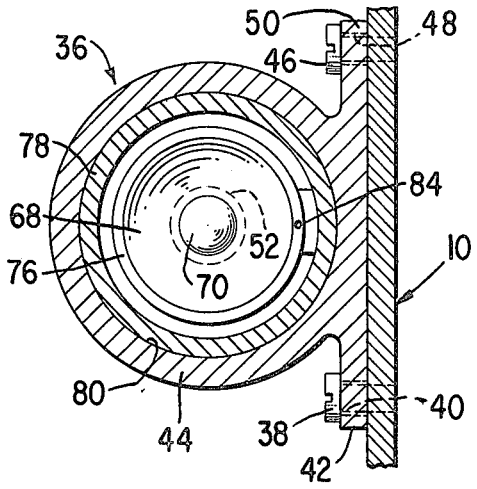
FIG. 4 is a cross sectional view on the plane of the line 4—4 of FIG. 3.

A safety device 36 according to the invention is shown attached to the rear of head end portion 10 of the machine with a fastener 38 which extends through a hole 40 in a flange 42 on the housing 44 of the device and into the machine, and with a fastener 46 which extends through a hole 48 in a flange 50 of the housing and into the machine. Such safety device 36 (see FIG. 3) includes an elongated member 52 which is mounted in housing 44 for pivotal movement in any plane that includes the longitudinal axis of the member. The elongated member is so mounted in the housing by means of a ball joint 54 which includes a spherical bulb 56 at an intermediate location on the member, and spherical seats for the bulb 56 including a seat 58 formed in the structure of the housing and a seat 60 provided in a bearing 62 having a threaded connection at 63 with the housing. As shown, the elongated member includes parts 52*a* and 52*b* joined by a crossed-T connection at 53, the member being pieced to facilitate assembly of the safety device.

Elongated member 52 extends in one direction from the bulb 56 to terminate beyond the housing in a ring 64, and extends in the opposite direction within the housing where it terminates in a cylindrical flange 66. The end surface 68 of the cylindrical flange is curvilinear and is contacted by a ball 70 which is biased against the surface by means of a spring 72 located in a recess 74 under an adjusting screw 75 in a top cover portion of the housing 44. The ball 70 acting against curvilinear surface 68 serves to normally maintain elongated member 52 in a central position within housing 44.

Contact means are provided for safety device 36 in the form of an electrically conducting ring 76 which is suitably secured to the periphery of flange 66, and an electrically conducting ring 78 which is located in an annular recess 80 in the housing 44. Ring 76 connects through a pigtail 82 with a wire 84 that extends beyond the housing, and ring 78 connects with a wire 86 extending beyond the housing.

In the secured position of safety device 36 on the rear side of the head portion 10 of the machine and with elongated member 52 in its normal position, the center of ring 64 is at least substantially in line with needle 28. A key 88 in member 52 is loosely received in a slot 90 defined by stops 91 and 93 that are integral with the housing 44, and such key approximately fixes the rotational position of member 52 on its longitudinal axis to prevent the ring from drifting out of its position of alignment with needle 28. The ring 64 is situated slightly above the sole plate 92 of presser device 16 when the presser device is in position (as shown in FIGS. 1 and 2) for sewing.

If an operator, during a sewing operation, moves a finger too close to the needle 28, he contacts ring 64 and causes elongated member 52 to swing out of its normal position about the joint 54. Ring 76 is thereby caused to engage ring 78 and electrically interconnect wires 84 and 86. The ability of member 52 to swing in any direction within the range of motion required to cause the ring 76 to engage ring 78 is unaffected by key 88 in slot 90 because of the loose fit between the key and slot. Member 52 is therefor pivoted in response to finger pressure in any direction on the ring 64 and is thereby rendered effective to connect leads 84 and 86 through the conducting rings 76 and 78. When finger pressure is removed from ring 64, elongated member 52 is returned to a central position in housing 44 by the biasing effect of spring 72 and the rings 76 and 78 disengage to disconnect the wires 84 and 86.

Figure 7:
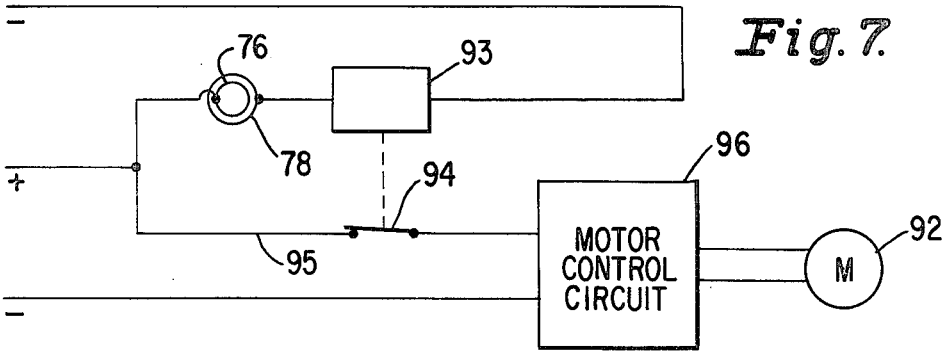
FIG. 7 is a schematic illustration indicating the manner in which the safety device of the invention is utilized to control the operation of a sewing machine.

The safety device 36 is utilized to discontinue the operation of the motor 92 of the sewing machine whenever the ring 64 is moved by an operator's fingers to cause ring 76 to engage ring 78. It is therefor intended that the rings 76 and 78 be included in circuitry suited to this purpose, such as the circuitry shown by way of example in FIG. 7 wherein the rings 76 and 78 when contacting, cause a relay 93 to open a contact 94 in a line 95 over which power is supplied to control circuitry 96 for motor 92. When rings 76 and 78 disengage after the removal of finger pressure from ring 64, relay 93 is caused to close contact 94 and power is restored to the motor control circuit to enable operation of the motor 92. Braking means which are not shown in the drawing but which may, for example, be of the type shown and described in U.S. Pat. No. 2,418,356 of J. O. Kleber, issued Apr. 1, 1947, may be employed to bring about an abrupt halt in the operation of the sewing machine when the motor is disconnected from the power source as a consequence of the engagement of rings 76 and 78.

Figure 6:
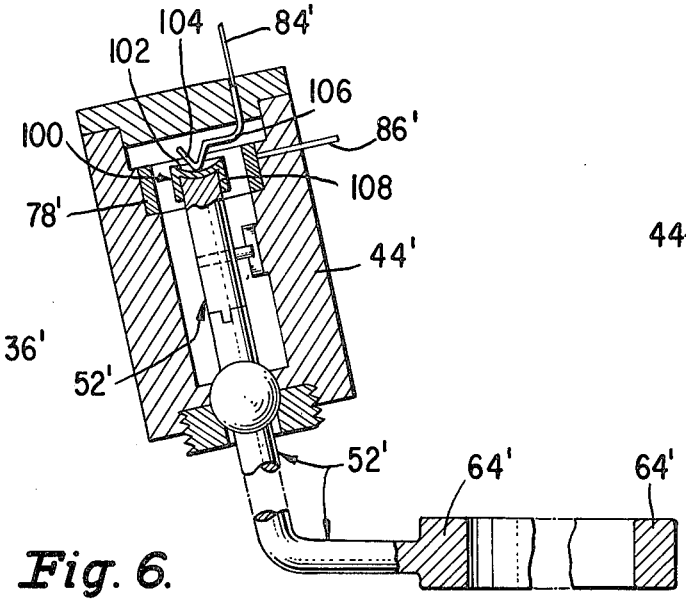
FIG. 6 is a sectional view similar to FIG. 3 taken through a modified form of the invention.
Figure 5:
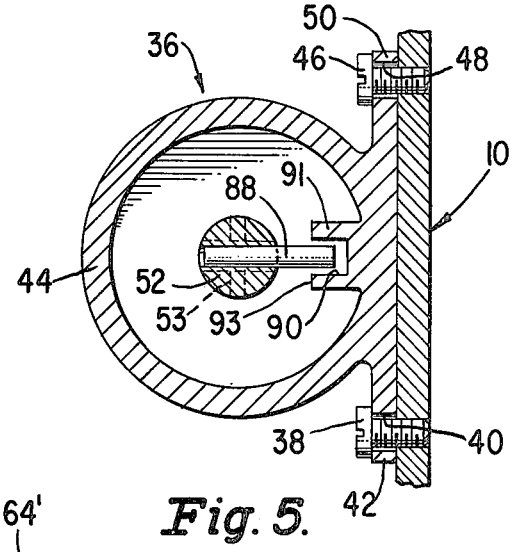
FIG. 5 is a cross sectional view on the plane of the line 5—5 of FIG. 3.

Reference is now made to FIG. 6 which shows a modified form of safety device according to the invention, and wherein parts corresponding to those shown in the device of FIGS. 1 through 5 are identified with like reference characters, except for the addition of a prime (') mark. It may be seen that in such device, elongated member 52' supporting ring 64' at one end is provided at the other end within the housing 44' with an electrically conductive cap 100 having a top concave surface 102. Surface 102 is engaged by a V-like formation 104 at the end of a flat spring 106 which is electrically conducting, and member 52' is biased by the spring to a central position as shown in the housing 44'. However, a member 52' is movable from its central position by finger pressure on the ring 64' and may be caused thereby to bring the depending flange 108 of cap 100 into engagement with electrically conductive ring 78' situated in the housing 44'. Upon the removal of finger pressure from the ring 64, the elongated member 52' is caused by spring 106 to return to its central position and cap 100 is disengaged from ring 78'. Spring 106 connects with electrical lead 84' and ring 78' connects with electrical lead 86'. The leads 84' and 86' are interconnected and disconnected by the engagement and disengagement respectively of cap 100 with ring 78', and obviously may be further connected in circuit for control purposes as already described for the device of FIGS. 1 through 5.

Electrical insulation, although not shown in the drawings, may be provided in each of the described safety devices to isolate the engageable and disengageable electrically conducting elements from the housing of the device and the casing of a sewing machine, or alternatively the materials utilized in the construction of said devices may be judiciously selected to prevent the flow of current in the housing or machine.

It is to be understood that only particular preferred embodiments of the invention have been shown and described herein. Many other modifications will occur to those skilled in the art and it is intended to cover all such modifications and variations of the disclosed embodiments as fall within the true spirit and scope of the invention.

I claim:

1. A safety device for a sewing machine including an electric motor which drives the machine and control circuitry therefor, said device comprising a ring to extend around the sewing needle of the machine; a housing securable on the machine; an elongated member which extends from the housing and supports the ring, the member being mounted in the housing for pivotal movement by the ring in any plane which includes the longitudinal axis of the member; means biasing the elongated member into a normal position in the housing; and contact means connectible with said motor control circuitry and operable by displacement of the elongated member from its normal position for discontinuing operation of the motor.

2. A safety device as defined in claim 1 wherein the contact means includes a contact element fixed in the housing and a contact element on the elongated member.

3. A safety device as defined in claim 1 wherein the housing is adapted for attachment to the rear side of a head end portion of the sewing machine.

4. The combination of claim 1 including a ball joint between the elongated member and housing to accommodate pivotal movement of the member in any plane including its longitudinal axis.

5. The combination of claim 1 wherein the biasing means includes a spring for urging the elongated member into said normal position.

6. A safety device according to claim 2 wherein at least one contact element is a conducting ring.

7. A safety device according to claim 2 wherein both contact elements are rings.

8. The combination of claim 4 wherein the ball joint includes a spherical bulb on the elongated member and spherical seats in the housing.

9. The combination of claim 5 including a curvilinear surface on the elongated member, and a ball in the housing and in contact with the said curvilinear surface, said spring being disposed between the housing and ball to press the ball against said surface and thereby urge the elongated member into said normal position.

10. The combination of claim 5 wherein the contact means comprises a conducting ring affixed in the housing and a conducting cap on the elongated member within the housing; said spring engages the conducting cap, and the spring and said ring electrically connect with the motor control circuitry.

* * * * *